US005479245A

United States Patent [19]

Hino et al.

[11] Patent Number: 5,479,245

[45] Date of Patent: Dec. 26, 1995

[54] IMAGE FORMING APPARATUS

[75] Inventors: Toshio Hino, Kawasaki; Miki Yamamoto, Katano; Toshimasa Toyama, Kawasaki, all of Japan

[73] Assignee: Fujitsu Limited, Kawasaki, Japan

[21] Appl. No.: 381,089

[22] Filed: Jan. 31, 1995

Related U.S. Application Data

[63] Continuation of Ser. No. 121,511, Sep. 16, 1993, abandoned.

[30] Foreign Application Priority Data

Mar. 9, 1993 [JP] Japan ..... 5-072849

[51] Int. Cl.[6] ..... G03G 15/00

[52] U.S. Cl. ..... 355/245; 355/210; 355/260

[58] Field of Search ..... 355/210, 200, 355/245, 260, 208, 204

[56] References Cited

U.S. PATENT DOCUMENTS

| | | | |
|---|---|---|---|
| 4,339,196 | 7/1982 | Beck et al. | 355/245 X |
| 4,635,010 | 1/1987 | Miyai et al. | 355/200 |
| 4,705,384 | 11/1987 | Mizutani et al. | 355/200 |
| 4,910,551 | 3/1990 | Ouoda et al. | 355/200 |
| 4,939,547 | 7/1990 | Miyaji et al. | 355/245 |
| 5,020,471 | 6/1991 | Yoshikai | 355/245 X |
| 5,099,278 | 3/1992 | Sato | 355/200 |
| 5,138,372 | 8/1992 | DeCecca | 355/200 |

FOREIGN PATENT DOCUMENTS 4-323125 12/1992 Japan .

*Primary Examiner*—Matthew S. Smith

*Attorney, Agent, or Firm*—Armstrong, Westerman, Hattori, McLeland & Naughton

[57] ABSTRACT

An image forming apparatus is provided which ensures proper image forming when the apparatus is positioned either horizontally or upright. The apparatus includes a rotary, endless latent image carrier, and a latent image forming arrangement for forming a latent image on the latent image carrier. The apparatus also includes a developing arrangement for developing the latent image on the latent image carrier by using powdered developer, and a transferring arrangement for transferring a developed image on the latent image carrier to a sheet. The apparatus further includes a positioning mechanism for selectively positioning the developing arrangement relative to the latent image carrier at one of a first position corresponding to an upright installation of the apparatus and a second position corresponding to a horizontal installation of the apparatus.

47 Claims, 12 Drawing Sheets

FIG.5
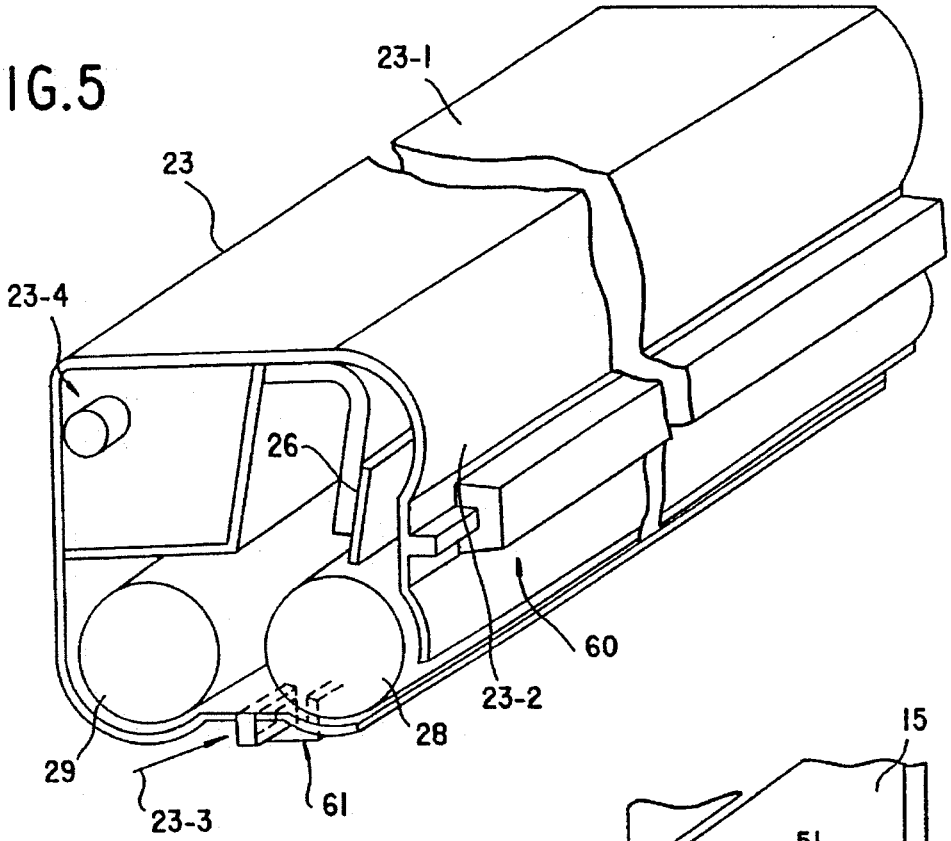
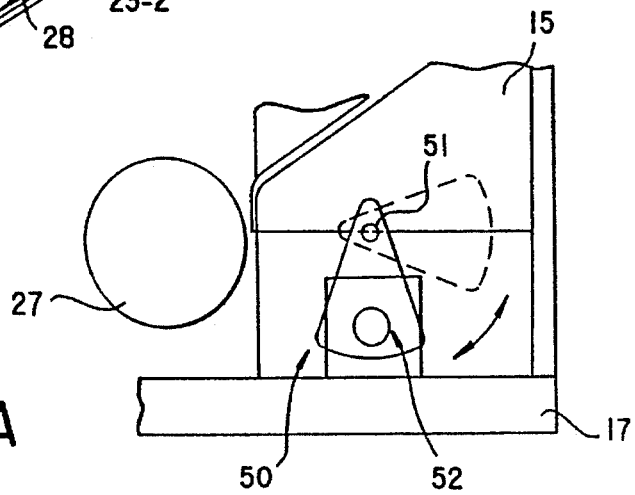
FIG.7A
FIG.7B
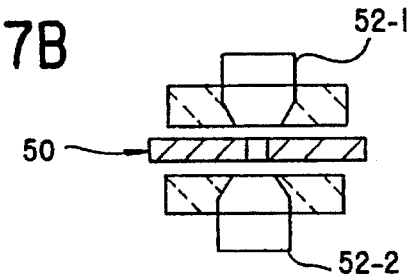

IMAGE FORMING APPARATUS

This application is a continuation of application Ser. No. 08/121,511 filed Sep. 16, 1993, now abandoned.

BACKGROUND OF THE INVENTION

1. Field of the Invention

The present invention relates to an image forming apparatus that can perform image forming while positioned either upright or horizontally, and particularly to an image forming apparatus that in consonance with its installed attitude feeds powered developer from a developing unit to a latent image carrier.

2. Description of the Related Art

To satisfy the demand for plain paper image recording, latent image forming apparatuses, such as electrophotographic apparatuses, are employed for such image forming apparatuses as copy machines, printers, and facsimile machines. In such an image forming apparatus, electrostatic latent images are formed on a photosensitive drum, and are developed by using powdered developer to visualize the images. After the developed images are transferred to a sheet of paper, the transferred images are fixed to the sheet.

As efficient utilization of office space is one of the objects of the recent trend towards automated offices, a demand has arisen for image forming apparatuses that can be positioned either upright or horizontally. Dependent on user need and preference, such an apparatus can be installed where the available space is restricted either horizontally or vertically.

Usually, electrophotographic printers are positioned and operated horizontally, that is, with their sheet feeding paths parallel to their base planes. The arrangement of the internally mounted developing units, etc. of these printers is designed for the effective utilization of gravitational attraction. Therefore such printers function imperfectly when they are positioned and operated upright, that is, with their sheet feeding paths perpendicular to their base planes.

As examples of prior art, Japanese Unexamined Patent Publication No. Sho 58-130345 and Japanese Unexamined Utility Model Publication No. Sho 60-184061 disclose how to transport in an upright position image forming apparatuses that are operated horizontally. According to these prior art examples, spillage of powdered developer is prevented even when the apparatus is transported upright. For this purpose, a magnet is provided inside the developing unit to attract and retain the developer therein, or the developer is retained in the lower portion of the developing unit by gravity.

When such conventional image forming apparatuses are installed upright, however, the directional effect of gravity on the developing units is changed and internally stored powdered developer flows in a different direction. As a result, a developing process cannot be smoothly performed while the apparatuses are positioned upright. Since the objects of the above described prior art is to prevent developer from spilling when the apparatuses are positioned upright, this means that the flow of developer is stopped, and thus arranged apparatuses cannot perform developing processes as long as they are upright.

Another prior art example, Japanese Unexamined Patent Publication No. Hei 4-323125, discloses an image forming apparatus that forms images while it is positioned either horizontally or upright. This image forming apparatus will be explained while referring to FIG. 1. In FIG. 1A, the image forming apparatus is set up for horizontal operation; in FIG. 1B, the image forming apparatus is set up for upright operation.

As shown in FIG. 1A, a sheet of paper in a hopper 80 is extracted by a pickup roller 81 and fed to a photosensitive drum 90. Positioned around the periphery of the photosensitive drum 90 are a charger 91, an LED head 92, a developing unit 93, a transfer roller 94, and a cleaner 95. The charger 91 electrifies the photosensitive drum 90, and the LED head 92 exposes the photosensitive drum 90 to light image and forms electrostatic latent images on its surface. Thereafter, powdered developer is supplied by the developing unit 93 to develop-the electrostatic latent images on the photosensitive drum 90, and the developed images on the photosensitive drum 90 are transferred to the fed sheet by the transfer roller 94. The sheet to which the images are transferred is then fed to a fixing unit 96 to fix the developed images on the sheet. Finally, the sheet is discharged to a stacker 84 by a discharge roller pair 82 and 83. An image forming process performed by the apparatus while it is upright, as is shown in FIG. 1B, is the same as is described above.

For this prior art example, the specific processing performed by the developing unit 93 when the apparatus is positioned upright and horizontally is not described. Investigating the toner moving operation of FIGS. 1A and 1B, however, since supplemental toner is fed vertically from the upper compartment of the developing unit 93 when the apparatus is positioned horizontally as is shown in FIG. 1A, toner supplementation is enabled by gravitational attraction of the toner. But when the apparatus is in an upright position, as is shown in FIG. 1B, the feeding direction for toner is horizontal and it seemed that toner supplementation cannot be efficiently performed. Further, the developing unit 93 supplies developer to the photosensitive drum 90 in a horizontal direction, as is depicted in FIG. 1A for the horizontal installation position, but the developing unit 93 must feed the developer upward, against the force of gravity, when the apparatus is in an upright position, as is depicted in FIG. 1B. Also, the developer tends to migrate to the toner supplementation compartment and the height of the retained developer is not constant. Consequently, the developing roller feeds developer unevenly and the resulting developed images are often imperfectly formed.

SUMMARY OF THE INVENTION

It is therefore an object of the present invention provide an image forming apparatus that consistently forms images regardless of the installation attitude of the apparatus.

It is another object of the present invention to provide an image forming apparatus that consistently performs a developing process when it is positioned either horizontally or upright.

It is still another object of the present invention to provide an image forming apparatus that prevents deterioration of the flowability of developer in a developing unit due to the installation attitude and consistently performs a developing process.

It is a further object of the present invention to provide an image forming apparatus that has a simple structure and consistently performs a developing process regardless of the installation attitude of the apparatus.

It is yet another object of the present invention to provide an image forming apparatus that has a developing unit at an optimal position for development in consonance with the installation attitude of the apparatus.

To achieve these objects, an image forming apparatus according to the present invention comprises: a rotary, endless latent image carrier; latent image forming means for forming a latent image on the latent image carrier; developing unit for developing the latent image on the latent image carrier by using powdered developer; transferring unit for transferring a developed image on the latent image carrier to a sheet; and a positioning mechanism for positioning the developing unit relative to the latent image carrier, either at a first position corresponding to an upright installation of the apparatus or at a second position corresponding to a horizontal installation of the apparatus.

With this arrangement, since the correlative positions of the developing unit and the latent image carrier can be changed in consonance with the installation attitude of the apparatus, the developing means can be set to correspond to the optimal flow direction for the developer. Developing conditions are therefore optimized regardless of whether the apparatus is positioned horizontally or upright, and image forming processing can be consistently performed.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principle of the invention.

FIG. 5 is a perspective view of a developing unit positioning mechanism of the image forming apparatus shown in FIG. 3;

FIG. 7A is a diagram illustrating the arrangement of an installation attitude detecting mechanism in FIG. 3;

FIG. 7B is a top view of the installation attitude detecting mechanism in FIG. 7A;

DETAILED DESCRIPTION OF THE PREFERRED EMBODIMENT

Figure 1A:
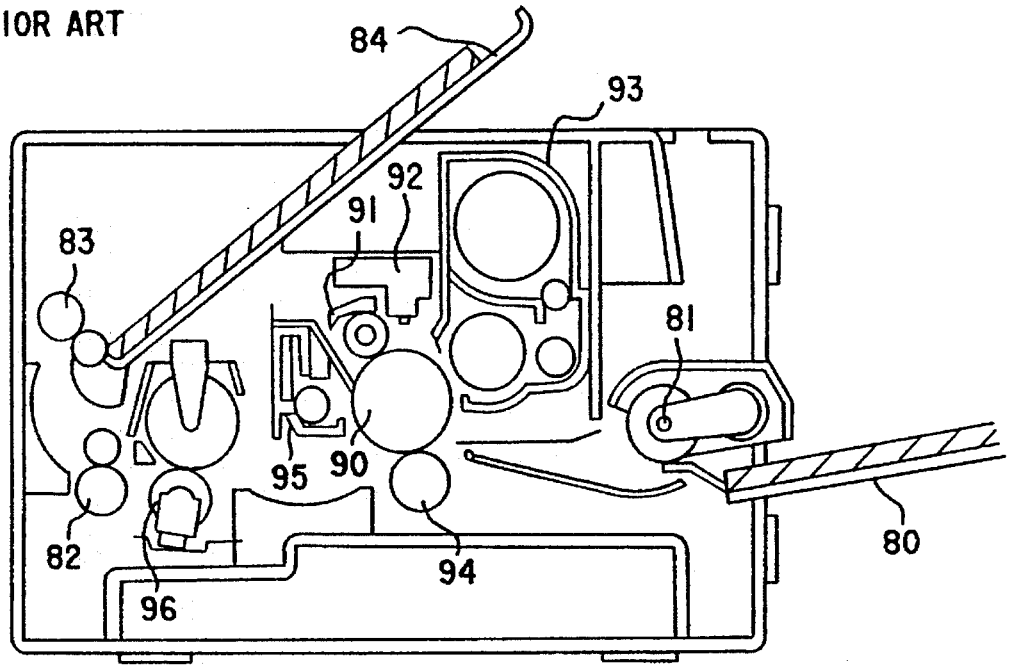
FIG.1A PRIOR ART
FIGS. 1A and 1B are diagrams for explaining prior art.
Figure 1B:
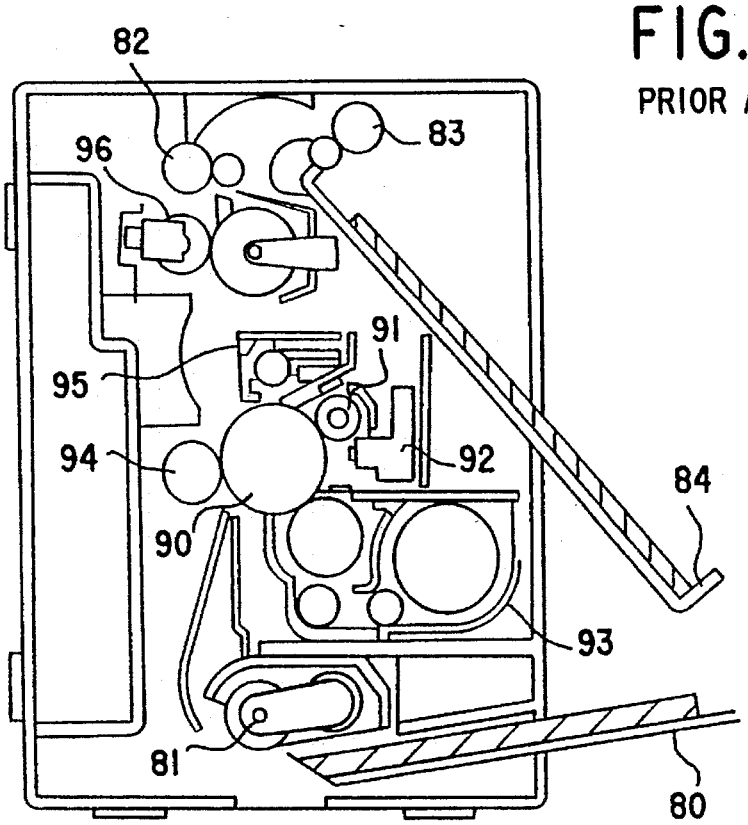
FIG.1B PRIOR ART
Figure 2B:
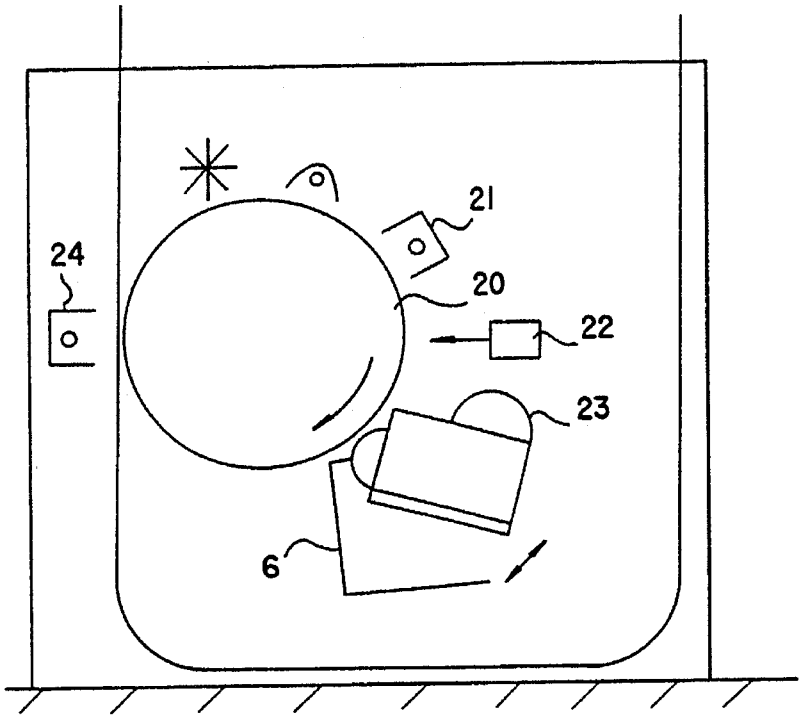
FIGS. 2A and 2B are diagrams showing the principle of the present invention.
Figure 2A:
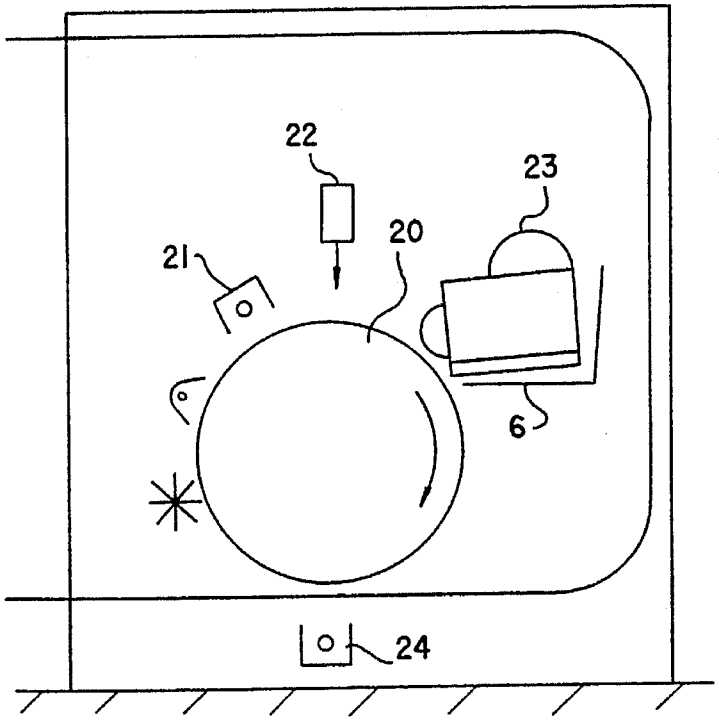

FIGS. 2A and 2B show the principle of the present invention; FIG. 2A shows an image forming apparatus installed horizontally and FIG. 2B shows the image forming apparatus installed upright. First of all, the principle of the present invention will be described.

As shown in FIG. 2, a photosensitive drum 20 is electrified by a Charger 21. When the photosensitive drum 20 is then exposed to light image by an image exposer 22, electrostatic latent images are formed on its surface. The electrostatic latent images on the photosensitive drum 20 are developed by a developing unit 23. Toner images are transferred from the photosensitive drum 20 to a fed sheet by a transfer unit 24. Such an image forming apparatus has a positioning mechanism 6 that alters the position of the developing unit 23. To ensure the smooth flow of powdered developer, the positioning mechanism 6 arranges the developing unit 23 at the second position for the horizontal installations attitude (i.e. orientation) shown in FIG. 2A, and at the first position for the upright installation attitude in FIG. 2B.

Developing processing that is performed by the developing unit 23 is therefore consistent, however the image forming apparatus is installed, i.e., when it is either installed horizontally or upright. A consistent image forming process is therefore ensured when the image forming apparatus is positioned either horizontally or upright.

Figure 3:
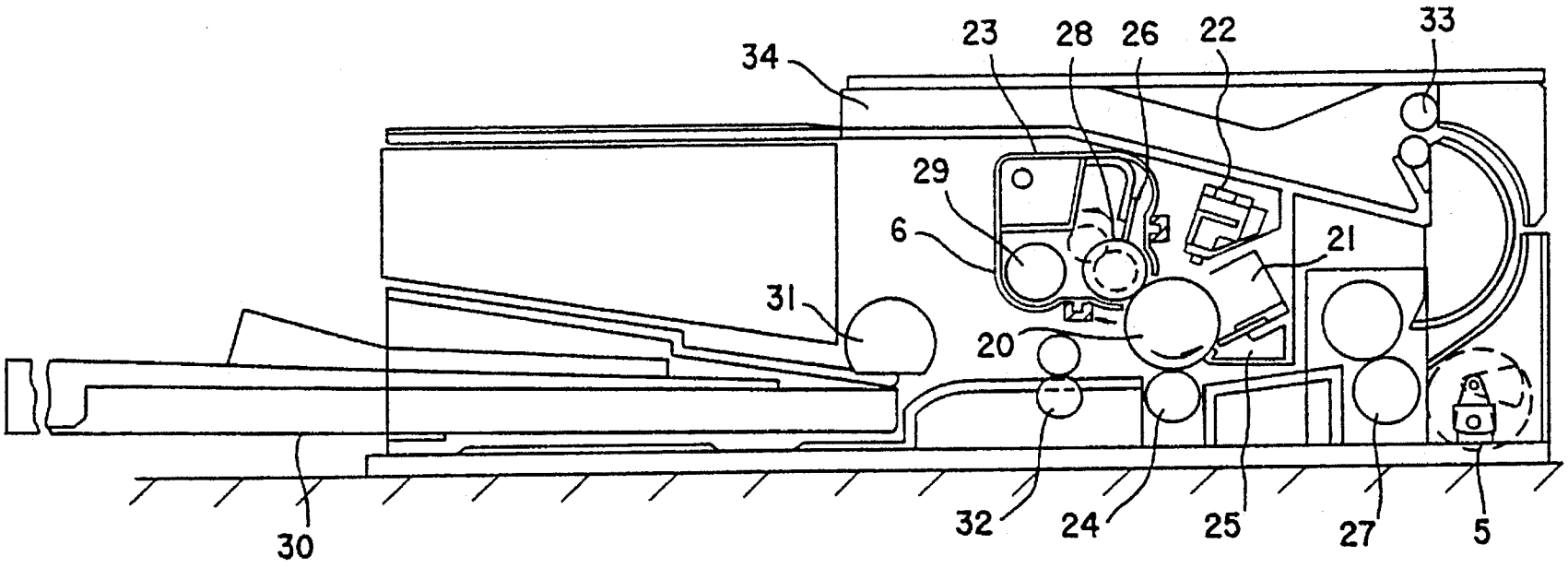
FIG. 3 is a diagram illustrating the arrangement of an image forming apparatus according to one embodiment of the present invention.
Figure 4:
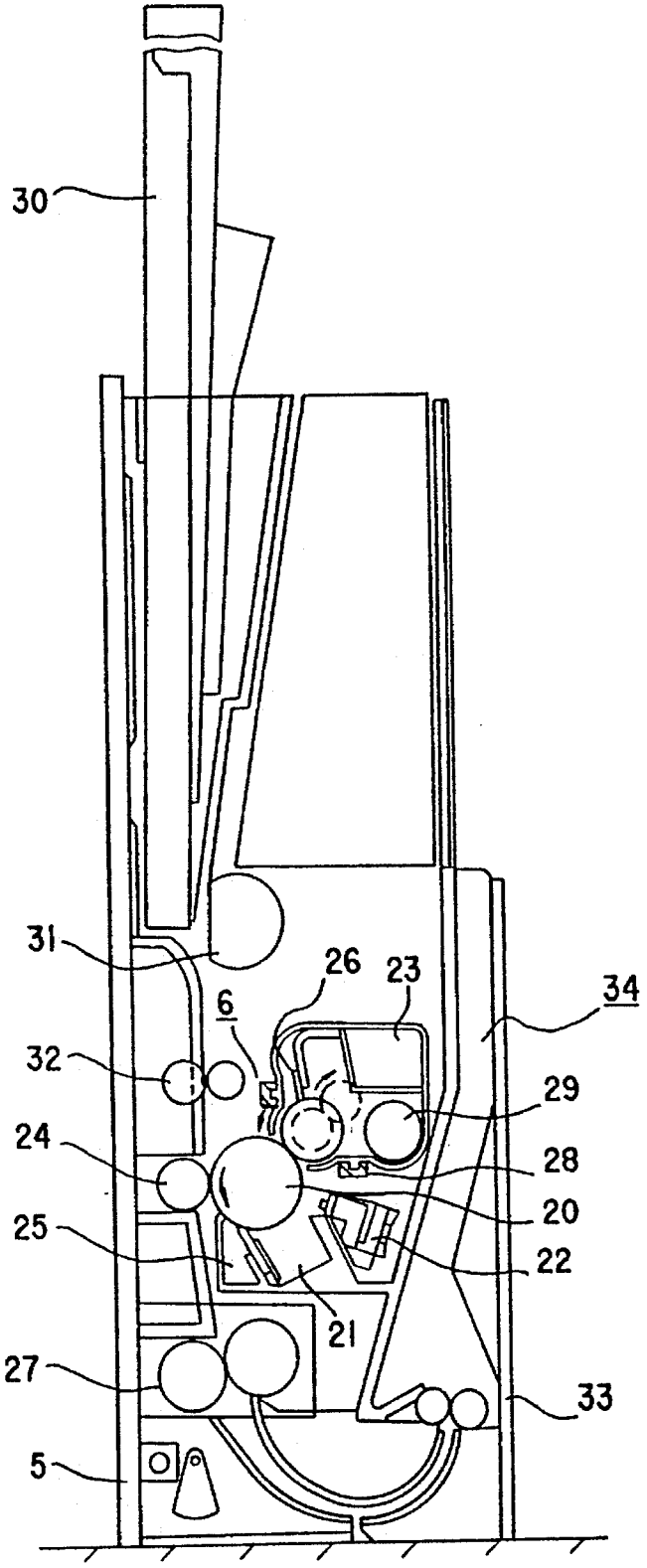
FIG. 4 is a diagram showing the image forming apparatus, shown in FIG. 3, when it is positioned upright.
Figure 6:
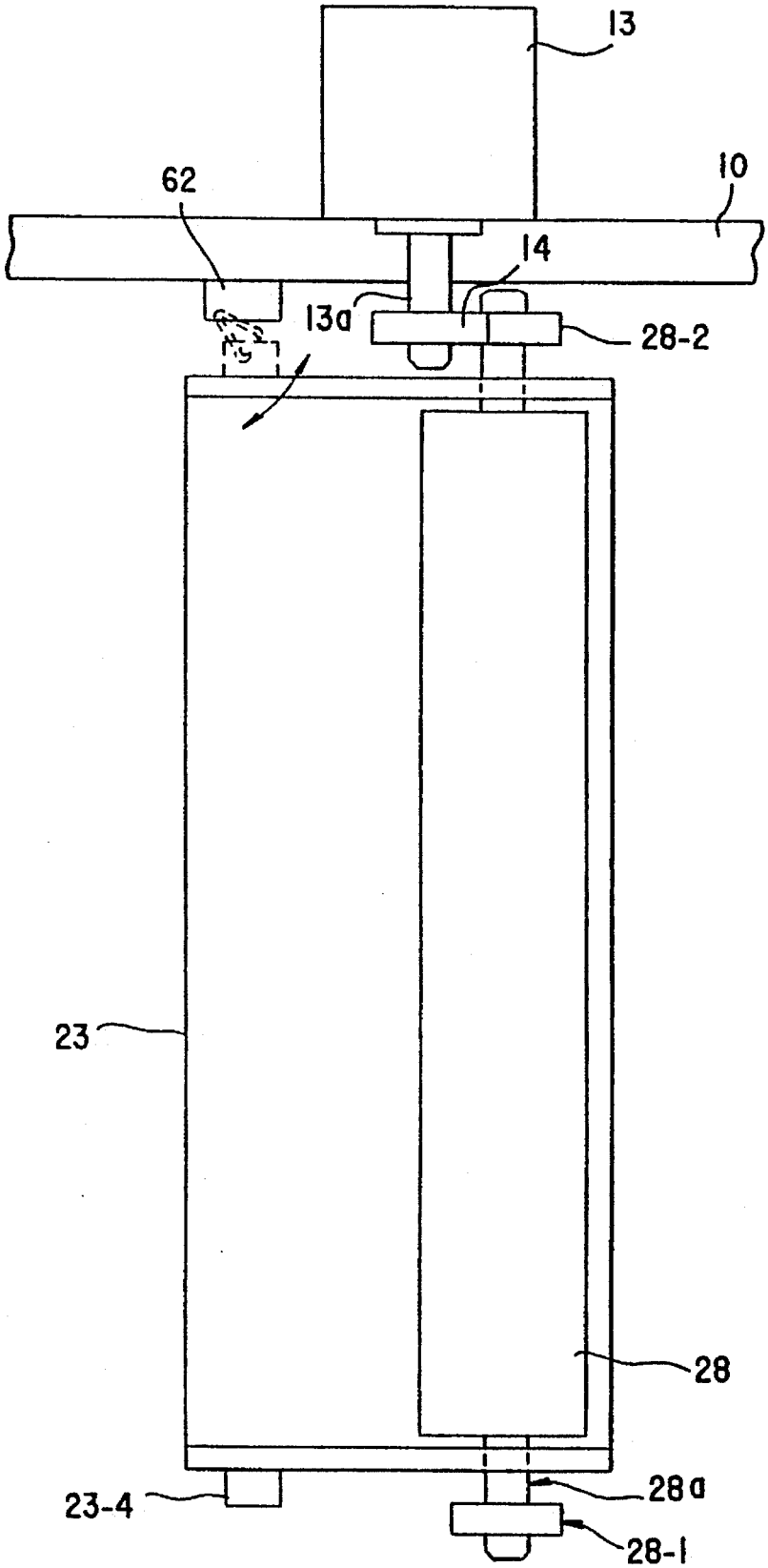
FIG. 6 is a top view showing the developing unit positioning mechanism shown in FIG. 5.

FIG. 3 shows the arrangement of an image forming apparatus according to the embodiment of the present invention; FIG. 4 shows the image forming apparatus in the upright position; FIG. 5 is a perspective view of the positioning mechanism in FIG. 3; FIG. 6 is a top view of the positioning mechanism in FIG. 5; and FIGS. 7A and 7B are explanatory diagrams for an installation attitude detecting mechanism in FIG. 3. The image forming apparatus in FIG. 3 represents an electrophotographic printer.

In FIG. 3, the photosensitive drum 20 is an aluminum drum that is coated to a thickness of about 26 microns with a separated-function organic photosensitive material. The photosensitive drum 20, which has an external diameter of 24 mm, is rotated counterclockwise, as is indicated by an arrow in FIG. 3, at a peripheral velocity of 60 mm/s. The primary charger 21, which includes a scotorton, uniformly charges the surface of the photosensitive drum 20 to −650 V, for example.

The LED optical unit 22 exposes the uniformly charged photosensitive drum 20 to light image to form electrostatic latent images. The LED optical unit 22 in this embodiment is an integrated LED optical system comprising an LED array and a CELLPHOC array. As the LED optical unit 22 generates light images according to applied image pattern signals and projects them onto the photosensitive drum 20, electrostatic latent images that carry charges of from −50 to −100 V are formed on the photosensitive drum 20.

The developing unit 23 supplies charged toner to the electrostatic latent images on the photosensitive drum 20 to visualize the images. The developing unit 23 includes a developing roller 28 that is formed of a metal sleeve and a magnetic roller that has a plurality of magnetic poles and that is fitted inside the sleeve. The magnetic roller is fixed within the metal sleeve, so that as the sleeve is rotated it feeds magnetic developer to the photosensitive drum 20.

Provided in the developing unit 23 are a supply roller 29, which stirs the magnetic developer and supplies it to the developing roller 28, and a doctor blade 26, which maintains a constant thickness of the magnetic developer layer on the developing roller 28. The doctor blade 26 adjusts the amount of developer, which the developing roller 28 supplies to the photosensitive drum 20, so that the quantity available for developing electrostatic latent images on the photosensitive drum 20 is neither excessive nor insufficient. To regulate the supply and availability of the developer, there is a gap between the edge of the doctor blade 26 and the surface of the developing roller 28 that is normally adjusted to provide an opening of approximately 0.1 to 1.0 mm.

As a magnetic carrier, the magnetic developer employs a magnetite carrier that has an average particle diameter of 70 microns; and for the toner, it employs a magnetic toner that has an average particle diameter of seven microns and that is produced by polymerization. Since the polymerization toner particles have uniform diameters, and thus the particles disperse evenly, during a transfer procedure that will be described later it is possible to obtain uniform adhesion of the toner particles to an image that is transferred from the photosensitive drum 20 to a sheet. Further, when polymerization toner particles are used the electric field in the transfer position is more uniform, and transfer efficiency is higher than when conventional pulverized toner is used. The transfer efficiency for pulverized toner ranges from 60 to 90%, while the higher transfer efficiency for polymerization toner is 90% or greater.

The transfer unit 24, which includes a transfer roller, electrostatically and mechanically transfers a toner image from the photosensitive/drum 20 to a sheet. A cleaner 25 is fitted with a cleaner blade that mechanically removes residual toner from the photosensitive drum 20 and cleans it.

A fixing unit 27 that is constituted by a heat roller, within which is mounted a halogen lamp as a heat source, and a pressure roller (backup roller), heats the sheet and then fixes the toner image to the sheet.

A sheet cassette 30, which holds a supply of paper sheets, is detachable from the apparatus. A pick roller 31 extracts sheets from the sheet cassette 30. When an extracted sheet abuts upon a resist roller 32, the resist roller 32 first aligns the leading edge of the sheet and then feeds the sheet to the transfer unit 24. A discharge roller pair 33 discharges an image-fixed sheet to a stacker 34. The stacker 34 is provided along the upper surface of the apparatus, and discharged sheets are stacked thereon.

An installation attitude detector 5 is provided to detect the installed attitude of the apparatus, as will be described later while referring to FIGS. 7A and 7B. The positioning mechanism 6 is employed to install the developing unit 23 or alter its position, as will be described later while referring to FIGS. 5 and 6.

The processing performed by the printer in this embodiment will now be explained. After the surface of the photosensitive drum 20 has been uniformly charged to −650 V by the primary charger 21, image exposure is performed by the LED optical system 22 and electrostatic latent images, which carry charges of from −50 to −100 V, are formed on the photosensitive drum 20 within a background portion that carries a charge of −650 V. A development bias voltage (−300 V) from a power supply (not shown) is applied to the sleeve of the developing roller 28 in the developing unit 23. Thereafter, the developing unit 23 supplies polymerization toner, which has been negatively charged by mixing it with the carrier, to develop and thus visualize, as toner images, the electrostatic latent images on the photosensitive drum 20.

When a sheet is extracted from the sheet cassette 30 by the pick roller 31, the resist roller 32 aligns the leading edge of the sheet and feeds the sheet toward the transfer unit 24. The toner image on the photosensitive drum 20 is electrostatically and mechanically transferred to the sheet by the transfer unit 24 and fixed to the sheet by the fixing unit 27. The sheet is then fed via a U-shaped feeding path and discharged to the stacker 34 by the discharge roller pair 33.

After the image is transferred, toner that remains on the photosensitive drum 20 is removed by the cleaner 25. Since polymerization toner with high transfer efficiency is employed, there is little residual toner on the photosensitive drum 20 and only a small cleaner is required. It is therefore possible to construct a compact apparatus.

The positioning mechanism 6 will now be explained while referring to FIGS. 5 and 6. As shown in FIG. 5, the positioning mechanism 6is constituted by a pair of first and second guide rails 60 and 61. The guide rails 60 and 61 are provided on a frame 10 shown in FIG. 6, and are positioned at a 90 degree angle relative to the developing unit 23. Further, as shown in FIG. 6, the positioning mechanism 6 includes a motor 13 that is provided on the frame 10 to drive the developing unit 23. A drive gear 14 is fitted around a shaft 13a of the motor 13. Provided on the frame 10 is a detector 62, a microswitch, that detects the installed direction of a developing unit 23 by sensing the presence or absence of a protrusion 23-4, which will be described later, that is provided on one end surface of the developing unit 23.

As shown in FIG. 5, mounted within the case 23-1 of the developing unit 23 are the supply roller 29, the developing roller 28, and the doctor blade 26. A side fixing guide 23-2 is provided along the side of the case 23-1, and a bottom fixing guide 23-3 is provided along the bottom of the case 23-1. As shown in FIGS. 5 and 6, provided on one end surface of the developing unit 23 is the direction detection protrusion 23-4 that is employed to establish the installed direction of the developing unit 23. Further, as depicted in FIG. 6, drive gears 28-1 and 28-2 are fitted around the respective ends of the shaft 28*a* of the developing roller 28.

In the developing unit 23, the supply roller 29 stirs developer in the bottom,of the case 23-1 and supplies it to the developing roller 28. The developing roller 28 feeds the developer to the photosensitive drum 20. The thickness of the layer of developer that is provided by the developing roller 28 is regulated by the doctor blade 26, and the developer is fed to the photosensitive drum 20 to perform a developing process.

As depicted in FIG. 5, the fixing guide 23-2 of the case 23-1 is inserted into the first guide rail 60, and the fixing guide 23-3 is inserted into the second guide rail 61. The sheet feeding path and a line that passes through the centers of the supply roller 29 and the developing roller 28 of the developing unit 23 are parallel to each other, as shown for the horizontally installed apparatus in FIG. 3.

When the developing unit 23 faces in the opposite direction, however, the fixing guide 23-3 of the case 23-1 is inserted into the first guide rail 60 and the fixing guide 23-2 is inserted into the second guide rail 61. The sheet feeding path is then perpendicular to a line that passes through the centers of the supply roller 29 and the developing roller 28 of the developing unit 23, as shown for the upright installed apparatus in FIG. 4. In this manner, the loading position of the developing unit 23 can be changed.

The installation attitude detector 5 will now be described while referring to FIGS. 7A and 7B. As shown in FIG. 7A, a pendulum 50 is suspended from and swings freely on a rotary shaft 51 that is attached to a guide frame 15, which forms the previously described U-shaped feeding path.

Mounted on a base board 17 of the apparatus is a photosensor 52 that includes a light emitter 52-1 and a light receiver 52-2 as shown in FIG. 7B. The path followed by the pendulum 50 travels between the light emitter 52-1 and the light receiver 52-2.

Therefore, when the apparatus is positioned horizontally, as in FIG. 3, the pendulum 50 interrupts the passage of light between the light emitter 52-1 and the light receiver 52-2 of the photosensor. 52, as indicated by the solid line in FIG. 7A. The horizontal attitude can be detected by the output of the photosensor 52. In the upright attitude in FIG. 4, the pendulum 50 does not interrupt the passage of light between the light emitter 52-1 and the light receiver 52-2 of the photosensor 52, as indicated by the dotted line in FIG. 7A. The upright attitude can be detected by the output of the photosensor 52.

Figure 8:
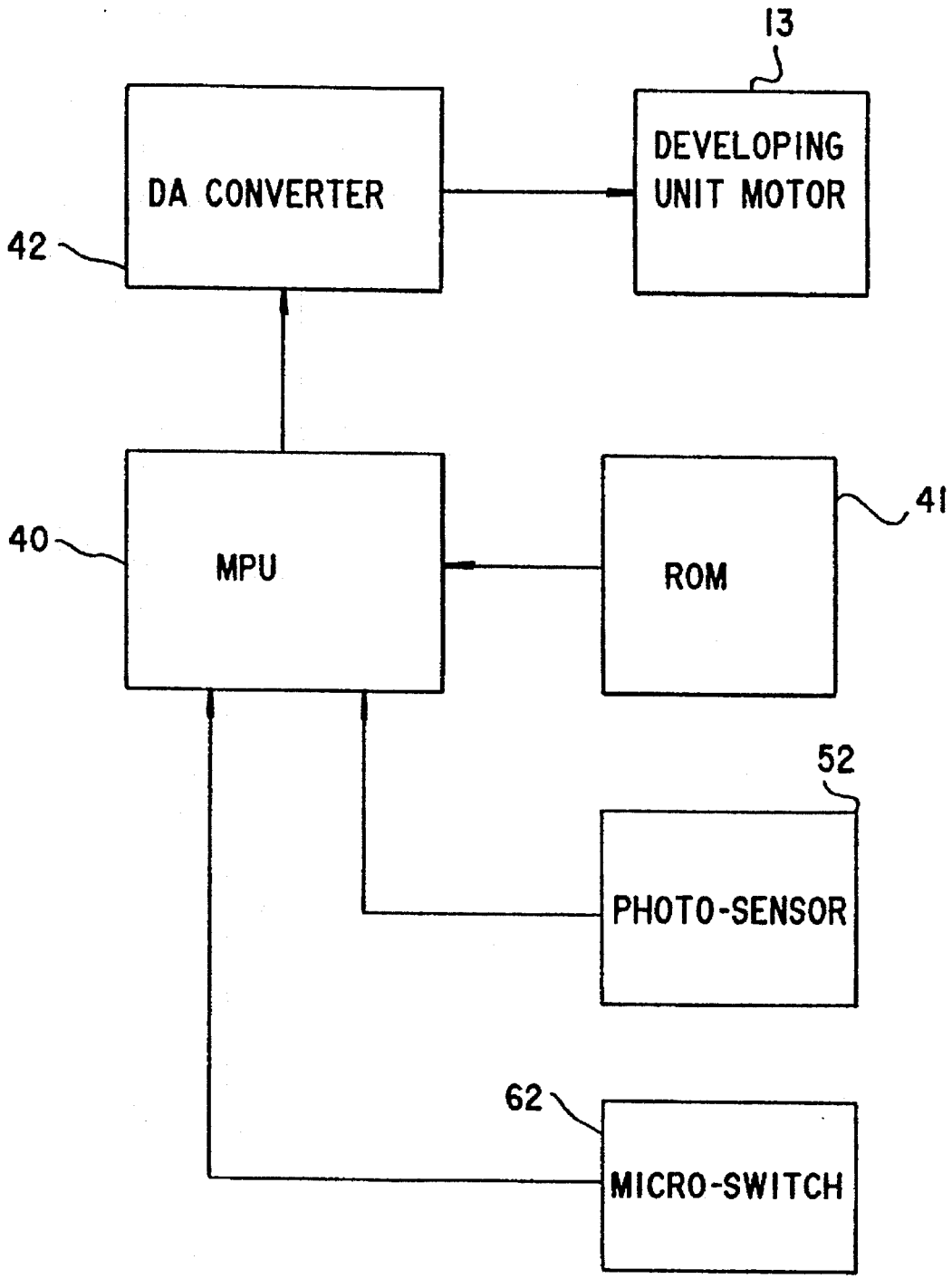
FIG. 8 is a control block diagram for the embodiment of the present invention.
Figure 9:
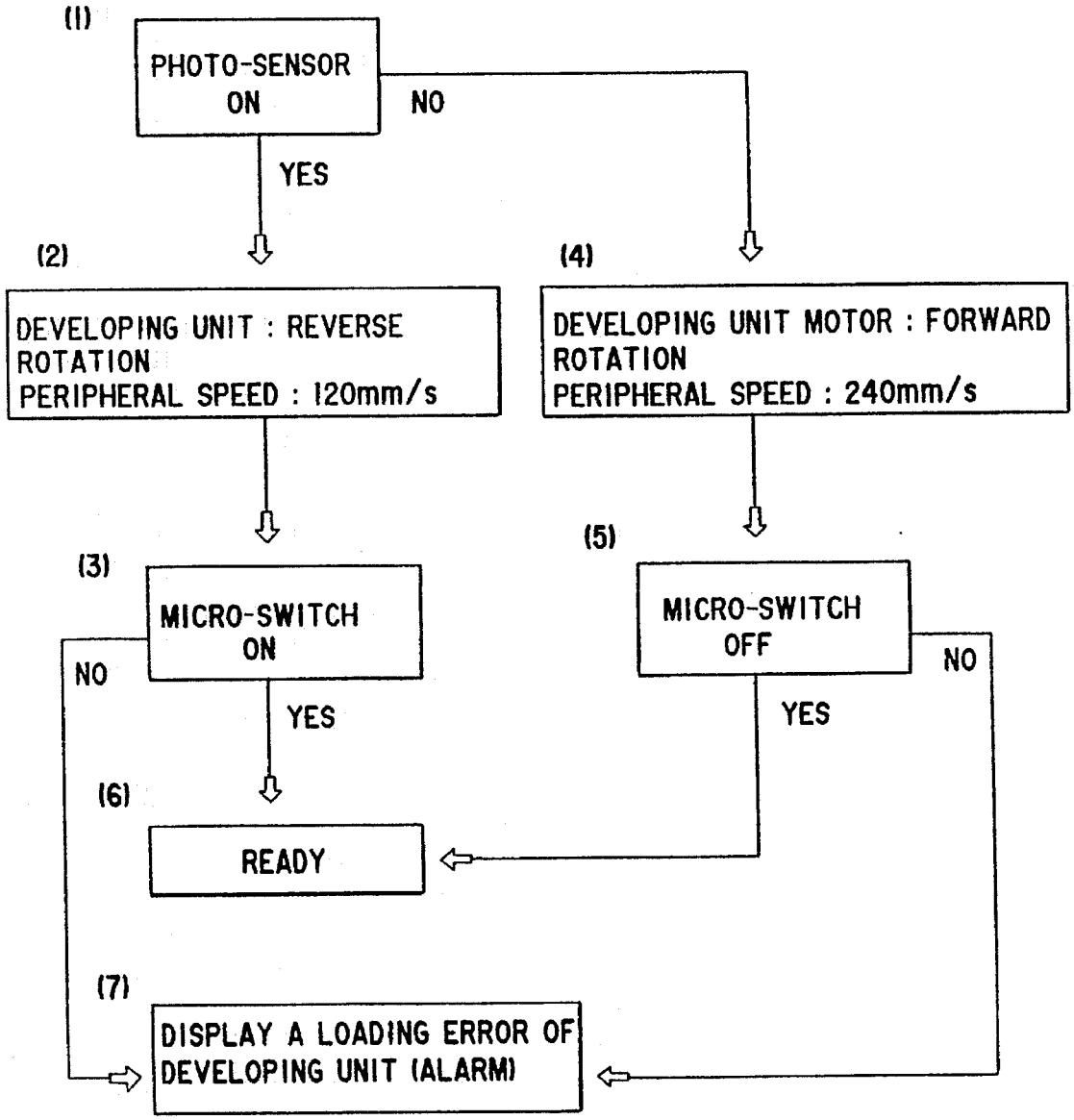
FIG. 9 is a flowchart showing initial processing according to the embodiment of the present invention.
Figure 10B:
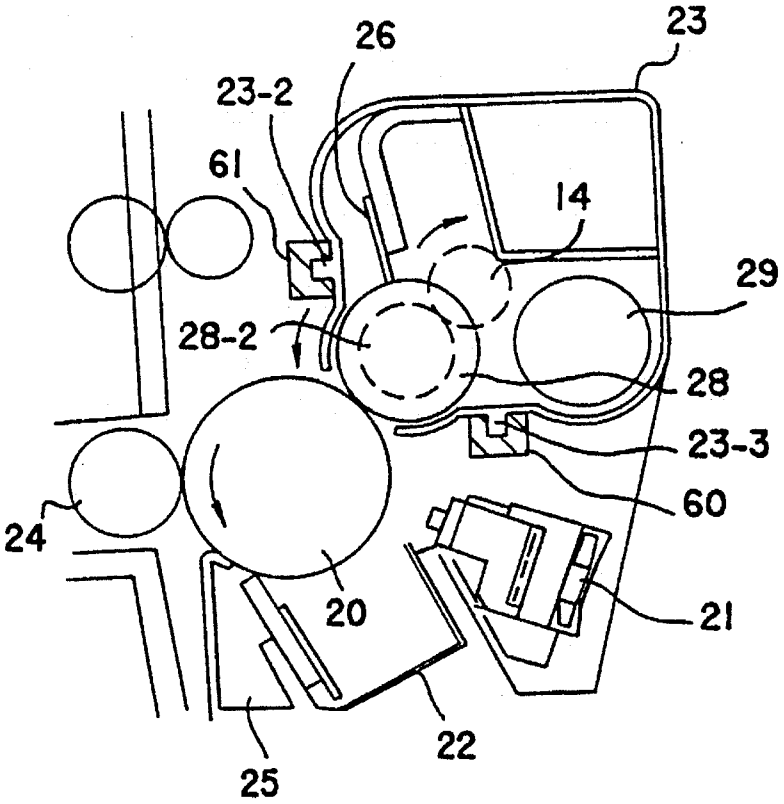
FIG. 10B is a diagram showing the developing unit as it is installed using the positioning mechanism in FIG. 5 when the apparatus is upright.
Figure 10A:
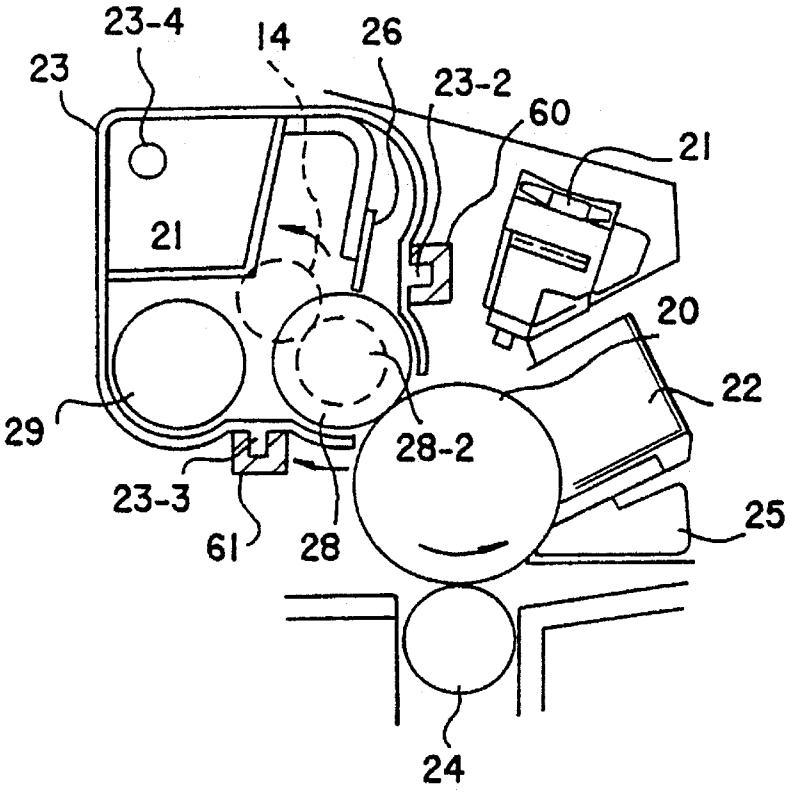
FIG. 10A is a diagram showing the developing unit as it is installed using the positioning mechanism in FIG. 5 when the apparatus is horizontal.

FIG. 8 is a control block diagram for the embodiment of the present invention; FIG. 9 is a flowchart that graphically depicts the initial processing for the embodiment of the present invention; FIGS. 10A and 10B are diagrams for explaining the processing for the embodiment of the present invention.

In FIG. 8, a controller 40, a microprocessor, controls the entire apparatus. A ROM (Read Only Memory) 41 is employed for storing operation programs, etc. that are executed by the controller (hereafter referred to as "MPU") 40. A DA converter 42 converts a motor drive digital value from the MPU 40 into an analog drive current to drive the developing unit motor 13. The output of the photosensor 52, which detects the installation attitude of the apparatus, is read by the MPU 40. The output of the microswitch (direction detection mechanism) 62, which detects the loaded direction of the developing unit 23, is read by the MPU 40.

The processing performed by the developing unit 23 will now be explained while referring to FIGS. 10A and 10B. When the apparatus is positioned horizontally, as is shown in FIG. 3, the developing unit 23 is loaded by inserting the side fixing guide 23-2 of the case 23-1 into the first guide rail 60, and by inserting the bottom fixing guide 23-3 into the second guide rail 61, as is shown in FIG. 10A. The sheet feeding path (the base plane in this case) and a line that passes through the centers of the supply roller 29 and the developing roller 28 of the developing unit 23 are parallel, as shown in FIGS. 3 and 10A. As the developer in the developing unit 23 is thus positioned between the supply roller 29 and the developing roller 28 by gravity, smooth feeding of the developer is possible.

The attitude of the developing unit 23 at this time is as shown in FIG. 6, with the drive gear 28-2 at the top in the diagram engaging the drive gear 14 of the motor 13 to rotate the developing roller 28. The rotation of the developing roller 28 relative to the photosensitive drum 20 should be with-rotation, i.e., clockwise rotation, as indicated by the arrow in FIG. 10A. The motor 13 therefore turns counterclockwise to rotate the developing roller 28 clockwise.

Also, as shown in FIG. 6, since the detection protrusion 23-4 is not positioned on the side of the developing unit 23 that is opposite the microswitch 62 on the frame 10, the microswitch 62 is not activated. The resulting OFF output of the microswitch 62 indicates that the developing unit 23 is loaded for horizontal operation. As is further shown in FIG. 7, since the pendulum 50 of the installation attitude detector 5 interrupts light transmission by the photosensor 52, the OFF output of the photosensor 52 indicates that the apparatus is positioned horizontally.

To install the apparatus upright, as is shown in FIG. 4, the developing unit 23 is first removed from the apparatus. Then, the developing unit 23 is reloaded by inserting the bottom fixing guide 23-3 of the case 23-1 into the first guide rail 60, and by inserting the side fixing guide 23-2 into the second guide rail 61, as is shown in FIG. 10B. The sheet feeding path (the base plane in this ease) and a line that passes through the centers of the supply roller 29 and the developing roller 28 of the developing unit 23, are parallel, as shown in FIG. 4. As the developer in the developing unit 23 is thus positioned between the supply roller 29 and the developing roller 28 by gravity, smooth feeding of the developer is possible.

The loading of the developing unit 23 is the opposite of that shown in FIG. 6. The drive gear 28-1 at the bottom in FIG. 6 engages the drive gear 14 of the motor 13 to rotate the developing roller 28. The rotation of the developing roller 28 relative to the photosensitive drum 20 should be counter-rotation, i.e., counterclockwise rotation, as indicated by the arrow in FIG. 10B, or the thickness of the developer layer cannot be controlled by the doctor blade 26. The motor 13 turns clockwise to rotate the developing roller 28 counterclockwise.

Opposite to what is shown in FIG. 6, the detection protrusion 23-4 is provided on the side of the developing unit 23 that is opposite the microswitch 62 of the frame 10, and the microswitch 62 is depressed. The activation of the microswitch 62 indicates that the developing unit 23 is loaded for upright operation. As is further shown in FIG. 7, since the pendulum 50 of the attitude direction detector 5 does not interrupt the light transmission of the photosensor 52, the resulting ON output of the photosensor 52 indicates that the apparatus is positioned upright.

A process for detecting an error in the loading direction of the developing unit 23, an initial process, will now be described.

(1) When the initial process of the apparatus is begun, the MPU 40 reads the output of the photosensor 52 to determine the installation attitude of the apparatus.

(2) When the output of the photosensor 52 is an ON output, the MPU 40 concludes that the apparatus is positioned upright, as is shown in FIG. 10B. The MPU 40 therefore instructs the DA converter 41 to initiate inverse rotation, which serves as the driving output for the developing unit motor 13. Also, since the conditions for the developing process are different when the developing roller 28 performs with-rotation relative to the photosensitive drum 20 and when the developing roller 28 performs counter-rotation relative to the photosensitive drum 20, the MPU 40 controls the peripheral velocity of the developing roller 28 so as to provide an equalizing peripheral velocity ratio of the developing roller 28 to the photosensitive drum 20.

For example, suppose that the peripheral velocity of the photosensitive drum 20 is 60 mm/s and that the value for the developing roller 28 in the peripheral velocity ratio of the developing roller 28 to the photosensitive drum 20 is "2". When the developing roller 28 is inversely rotated, the MPU 40, which controls the motor 13 via the DA converter 41, adjusts the speed of the motor 13 so that the developing roller 28 has a peripheral velocity of 120 mm/s.

(3) Sequentially, the MPU 40 reads the output of the microswitch 62 to determine the loaded direction of the developing unit 23. When the output of the microswitch 62 is ON, the MPU 40 concludes that the developing unit 23 has been loaded as is required for upright installation and program execution control advances to step (6). When the output of the microswitch 62 is OFF, the MPU 40 concludes that the developing unit 23 has been loaded as is required for horizontal installation and program execution control advances to step (7).

(4) When, at step (1), the output of the photosensor 52 is OFF, the MPU 40 concludes that the apparatus is positioned horizontally, as is shown in FIG. 10A. The MPU 40 therefore instructs the DA converter 41 to initiate forward rotation, which serves as the driving output for the developing unit motor 13. Also, since the conditions for the developing process are different when the developing roller 28 performs with-rotation relative to the photosensitive drum 20 and when the developing roller 28 performs counter-rotation relative to the photosensitive drum 20, the MPU 40 controls the peripheral velocity of the developing roller 28 to provide an equalizing peripheral velocity ratio of the developing roller 28 to the photosensitive drum 20.

For example, suppose that the peripheral velocity of the photosensitive drum 20 is 60 mm/s and that the value for the developing roller 28 in the peripheral velocity ratio of the developing roller 28 to the photosensitive drum 20 is "4". When the roller 28 is rotated forward, the MPU which controls the, motor 13 via the DA converter 41, adjusts the speed of the motor 13 so that the developing roller 28 has a peripheral velocity of 240 mm/s.

(5) Sequentially, the MPU 40 reads the output of the microswitch 62 to determine the loaded direction of the developing unit 23. When the output of the microswitch 62 is OFF, the MPU 40 concludes that the developing unit 23 has been loaded as is required for horizontal installation and program execution control advances to step (6). When the output of the microswitch 62 is ON, the MPU 40 concludes that the developing unit 23 has been loaded as is required for upright installation and program execution control advances to step (7).

(6) When, at step (3), the microswitch 62 is found to be ON, or when, at step (5), the microswitch is found to be OFF, and it is therefore apparent that the developing unit 23 has been loaded in consonance with the installation attitude of the apparatus, the MPU 40 sets the apparatus to ready and waits for a print command.

(7) When, at step (3), the microswitch is found to be OFF, or when, at step (5) the microswitch 62 is found to be ON, and it is therefore apparent that the developing unit 23 is not loaded in consonance with the installation attitude of the apparatus, to inform an operator of the error the MPU 40 activates an alarm to signal that the developing unit 23 is improperly loaded and displays a message on an operator panel.

As described above, since the developing unit 23 is loaded in consonance with the installation attitude of the apparatus, the direction in which the developer from the developing unit 23 flows relative to gravitational effect is constant, whether the apparatus is positioned horizontally or upright. Accordingly, consistent and smooth developing is possible without spillage of the developer and with no disruption in its supply.

Further, since not only the installation attitude of the apparatus is detected but also the loaded direction of the developing unit 23 is detected, when the developing unit 23 is not correctly loaded in consonance with the installation attitude an alarm is issued to halt the operation. In this manner, a developing process malfunction that is caused by the incorrect loading of the developing unit 23 is prevented.

Moreover, as the direction in which the developing roller 28 of the developing unit 23 is rotated is altered in consonance with the loaded attitude of the developing unit 23, the developing process can be smoothly performed. In addition, by changing the peripheral velocity of the developing roller 28, image developing on the photosensitive drum 20 can be smoothly performed.

In this manner, an electrophotographic printer that can be positioned either horizontally or upright can be provided.

Figure 11B:
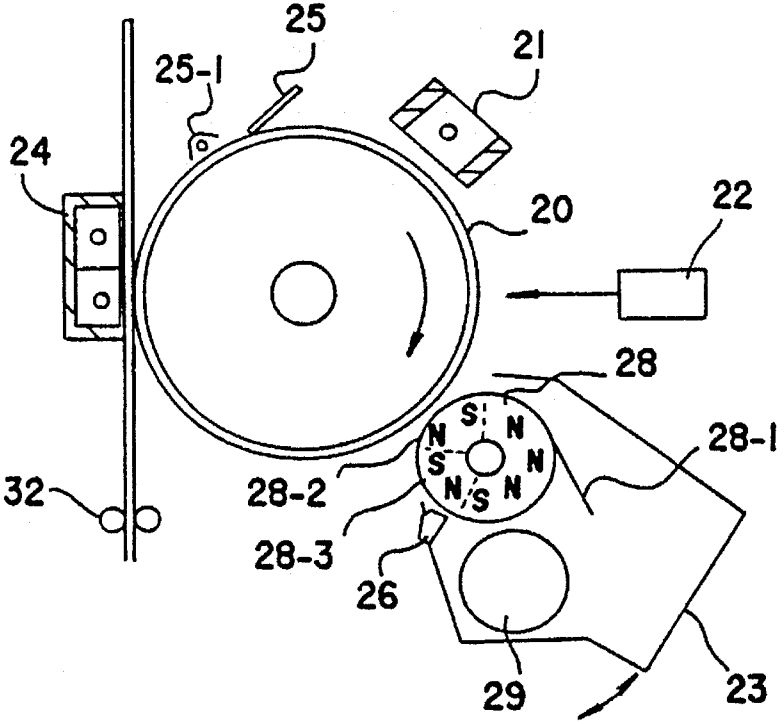
FIG. 11B is a diagram showing the developing unit as it is installed using the modified positioning mechanism when the apparatus is upright.
Figure 11A:
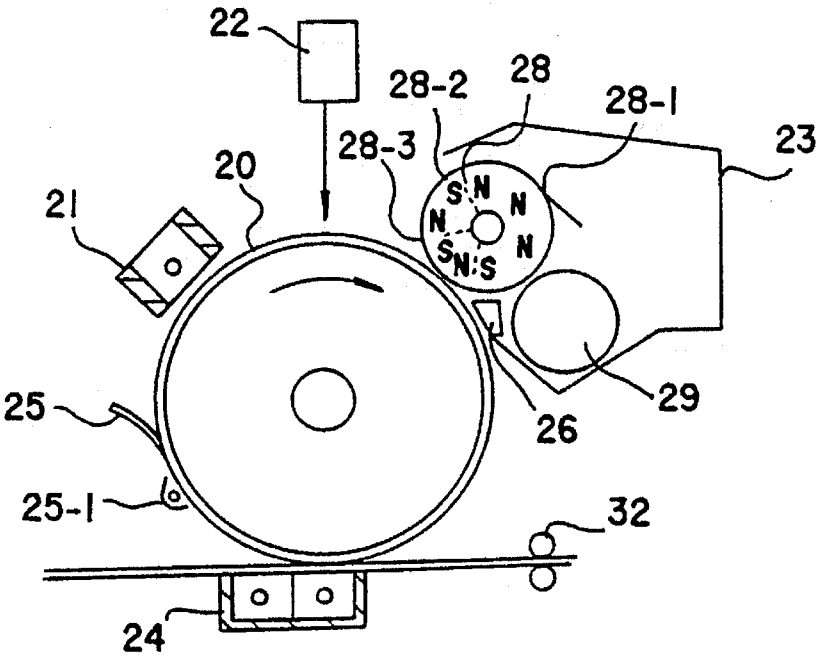
FIG. 11A is a diagram showing the developing unit as it is installed using the modified positioning mechanism when the apparatus is horizontal.
Figure 12:
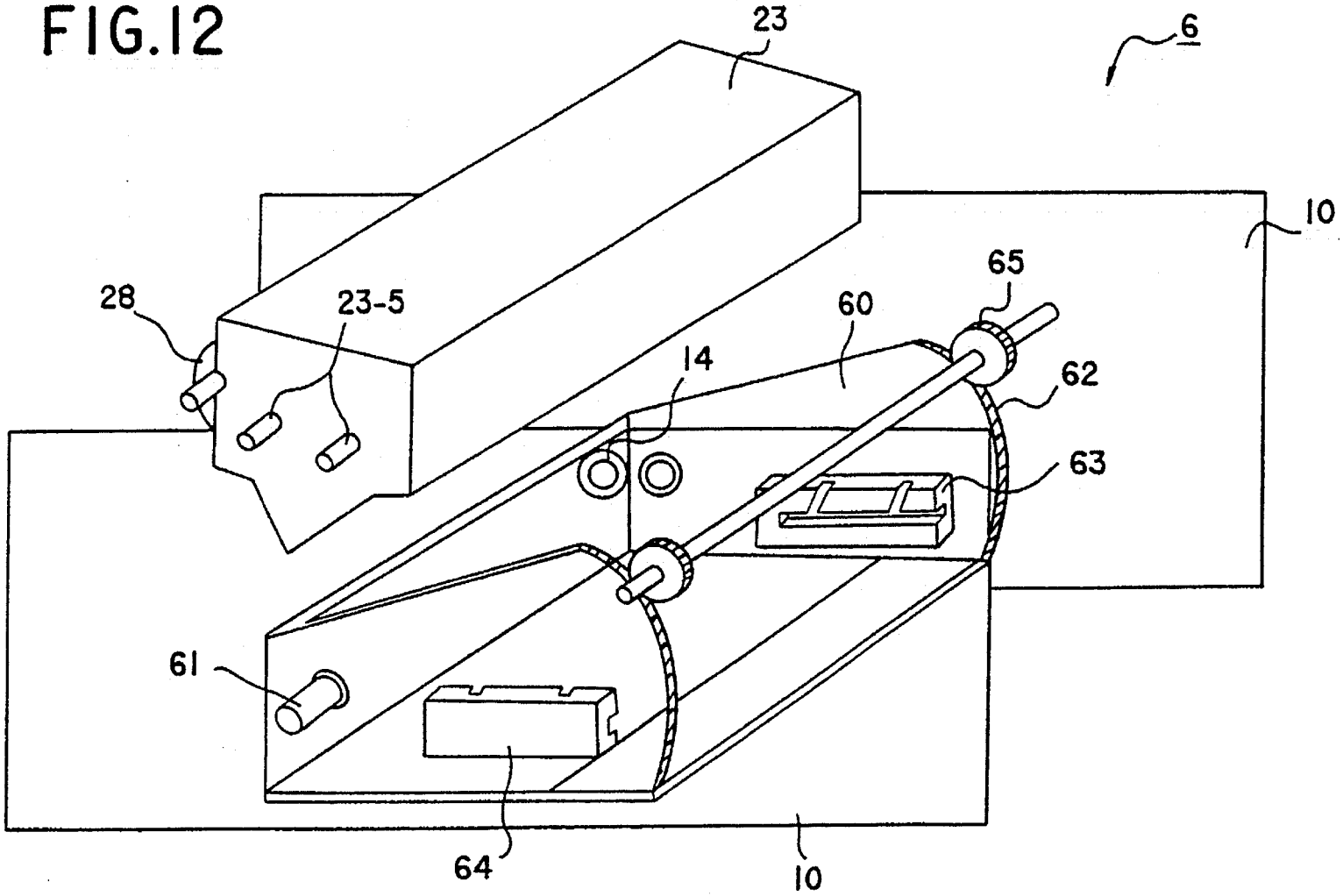
FIG. 12 is a perspective view of a modification of the developing unit positioning mechanism.

FIGS. 11A and 11B are explanatory diagrams for a modification of the positioning mechanism according to the present invention; FIG. 12 is a perspective view of the positioning mechanism in FIGS. 11A and 11B; and FIG. 13 is a top view of the positioning mechanism in FIG. 12.

The same reference numerals as are used to denote the components in FIGS. 2 through 10 are used to denote corresponding components in FIGS. 11A and 11B. This example shows a modification of the positioning mechanism of the printer in the embodiment in FIG. 3. In these diagrams, a sheet feeding direction is the opposite of that in FIG. 3 and only an image forming section is depicted.

In FIGS. 11A and 11B, a deelectrifier 25-1 consists of a deelectrification lamp. The deelectrifier 25-1 exposes the photosensitive drum 20 to a deelectrification light and removes electrostatic hysteresis from the photosensitive drum 20. In the developing unit 23, a fixed magnet inside the developing roller 28 has two magnetic poles 28-2 and 28-3. Provided above the developing roller 28 is a scraping board 28-1 that removes the developer from the developing roller 28 and returns it to the supply roller 29. The transfer unit 24 has a transfer device and a separation device that are constituted by corona dischargers.

Figure 13:
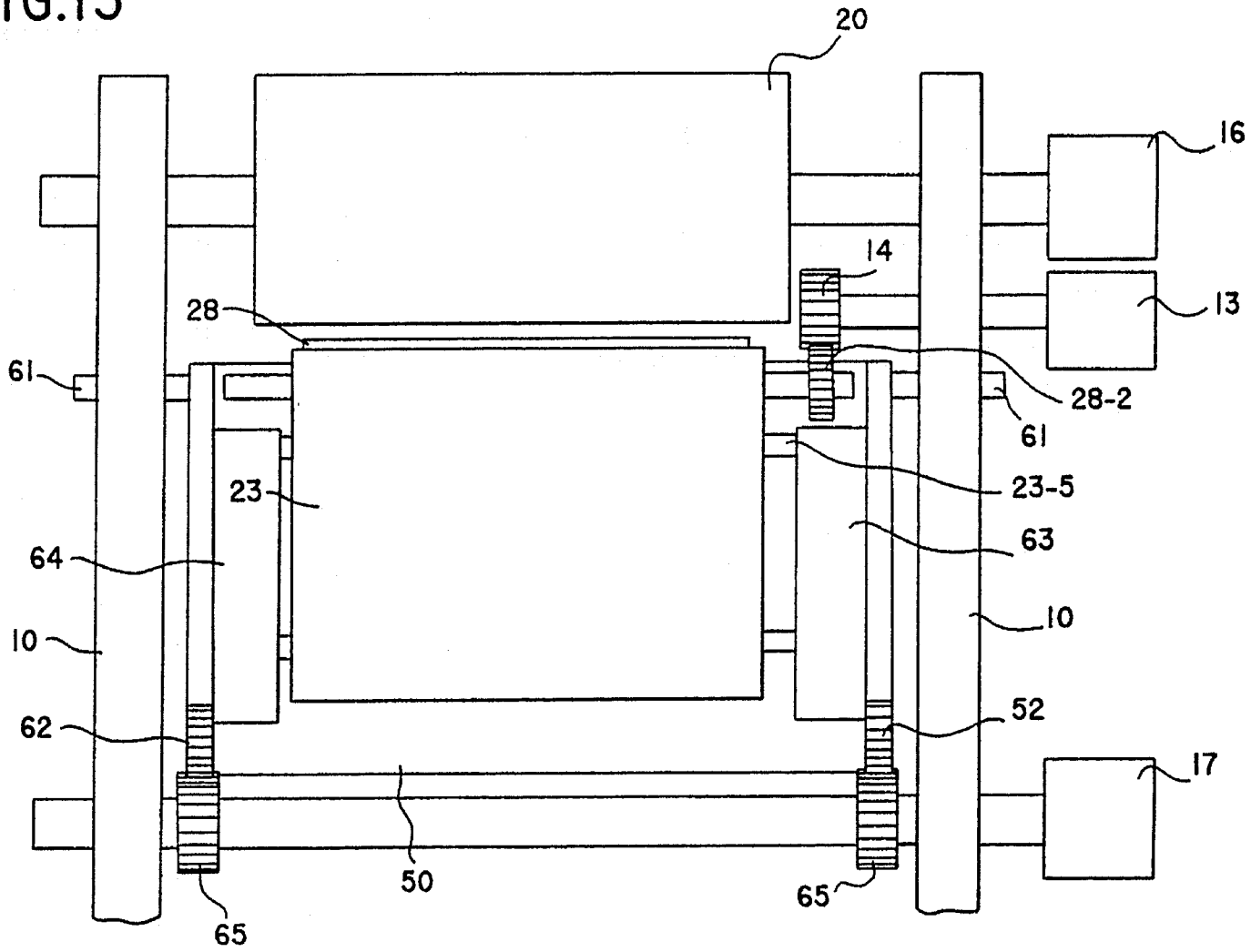
FIG. 13 is a top view of the developing unit positioning mechanism shown in FIG. 11.

In FIGS. 12 and 13, a movable base 60 is employed to retain the developing unit 23. The movable base 60 is attached to the frame 10 and moves around a shaft 61. Rotary gears 62 having serrated edges are provided on the respective ends of the side plates of the movable base 60. Fixing members 63 and 64 are provided on the respective side plates of the movable base 60 to support the developing unit 23. Drive gears 65 engage the rotary gears 62. The shaft of the drive gears 65 is fitted into the frame 10 and is rotated by a rotary motor 17 (shown in FIG. 13). Positioning pins 23-5, which are provided on either side of the developing unit 23, are inserted into the fixing members 63 and 64 to securely position the developing unit 23. A drum rotation motor 16 rotates the photosensitive drum that is provided in the frame 10.

In this modification, the positioning pins 23-5 of the developing unit 23 are inserted into the fixing members 63 and 64 of the movable base 60 to securely position the developing unit 23 in the movable base 60. As the rotary gears 62 and the drive gears 65 are engaged, the movable base 60 rotates about the shaft 61 in response to the rotation of the drive gears 65, and as a result the developing unit 23 is rotated.

In the horizontal installation shown in FIG. 11A, to perform image developing the developing unit 23 is positioned as shown in the diagram to supply developer to the photosensitive drum 20. In this case the developer is smoothly supplied to the developing roller 28, the second magnetic pole 28-3 faces the photosensitive drum 20 and image developing is performed.

In the upright installation shown in FIG. 11B, when an operator depresses a start key or a power-on key the controller 40 in FIG. 8 activates the motor 17, which rotates the drive gears 65 clockwise with respect to the view in FIG. 12. The movable base 60 rotates around the shaft 61 and moves upward with respect to the view in FIG. 12. When the angle of the rotation of the movable base 60 is about 60 degrees, the motor 17 stops. Then, the developing unit 23, which has also been rotated 60 degrees, is positioned as depicted in FIG. 11B. If the position of the developing unit 23 relative to the photosensitive drum 20 is as shown in FIG. 11A, when the apparatus is positioned upright, the developer is retained at the bottom of the developer 23 and developer supply by the developing roller 28 is difficult. When the developing unit 23 is moved and positioned as ms shown in FIG. 11B, however, the developer is retained around the supply roller 29 and the developer can be consistently and smoothly supplied to the developing roller 28. In this case, to perform image developing the first magnetic pole 28-2 faces the photosensitive drum 20.

When the apparatus is reinstalled horizontally, the motor 17 turns inversely upon the depression of the start key or the power-on key and returns the developing unit 23 to the original position shown in FIG. 11A for the performance of image developing.

Since the developing unit 23 is moved and positioned in the above described manner in consonance with the installation attitude of the apparatus, the direction in which the developer in the developing unit 23 flows relative to gravitational effect is almost constant, whether the apparatus is installed horizontally or upright. Consistent, smooth developing is therefore possible without spillage of the developer and with no disruption in its supply. Further, as the position of the developing unit 23 relative to the photosensitive drum 20 can be automatically changed, the operator workload is reduced.

Thus, an electrophotographic printer that can be positioned either horizontally or upright can be provided.

In this modification, as well as in the previously described embodiment, the installation attitude detector 5 may be provided so that the installation attitude can be determined from the output of the detector 5 and a motor can be driven to automatically change the position of the developing unit 23. As a rotation mechanism, a linear drive mechanism, such as a plunger, may be employed instead of the previously described gear mechanism. Further, although the simple structure where the developing unit 23 is rotated has been explained, the same effect can be obtained by moving the developing unit 23 around the photosensitive drum 20.

Besides the above described embodiment and modification, the present invention can be modified as follows: First, although a pendulum and photocoupler assembly is employed as an installation attitude detector, it is possible to employ an inclination sensor of another type, such as a mercury relay that opens/closes in consonance with inclination, or a device that detects variations in the electrostatic capacity, which result from the movement of fluid between plates. Second, although an LED optical system has been specified for employment as an image exposing unit, a laser optical system, a liquid shutter optical system, an EL (Electroluminescence) optical system, or other optical system may be used instead. Third, although any electrophotographic mechanism has been specified for employment as a latent image forming mechanism, another latent image forming mechanism that transfers a toner image (for example, an electrostatic recording mechanism) can be employed. Also, mediums other than plain paper may be used as sheets. Fourth, although in the explanation of the previous embodiment a printer was used as an example image:forming apparatus, the present invention can be employed for other image forming apparatuses, such as copy machines and facsimile machines. Fifth, although a two-component developer has been specified for employment as the developer, other developers, such as a one-component developer, may also be used.

As described above, according to the present invention, as a positioning mechanism that can vary the position of a developing unit is provided to vary the loading position of the developing unit in consonance with the installation attitude of an apparatus, developer can be fed steadily whether the apparatus is positioned either horizontally or upright. Regardless of the installation attitude of the image forming apparatus, therefore, image forming can be consistently performed, and to meet user needs, there is a degree of freedom in the installation attitude of the apparatus.

What is claimed is:

1. An image forming apparatus, which ensures image forming when positioned either horizontally or upright, comprising:

a rotary, endless latent image carrier;

latent image forming means for forming a latent image on said latent image carrier;

developing means for developing said latent image on said latent image carrier by using powdered developer;

transferring means for transferring a developed image on said latent image carrier to a sheet; and a positioning mechanism for selectively positioning said developing means relative to said latent image carrier, at one of a first position corresponding to an upright installation of said apparatus and a second position corresponding to a horizontal installation of said apparatus.

2. An image forming apparatus according to claim 1, wherein said positioning mechanism determines said first position and said second position of said developing means so that a flow direction of the powdered developer in said developing means is consistent both at the upright and horizontal installation of said apparatus.

3. An image forming apparatus according to claim 2, wherein said positioning mechanism includes setting members which are employed to locate said developing means at said first position or said second position in consonance with a desired loaded orientation of said developing means.

4. An image forming apparatus according to claim 3, further comprising a detection member provided in said developing means, and a loaded direction detection mechanism, provided in said positioning mechanism, for sensing the presence of said detection member to determine a loaded direction of said developing means.

5. An image forming apparatus according to claim 4, further comprising an installation orientation detection mechanism for detecting an installation orientation of said image forming apparatus, and a controller for determining, from an output of said loaded direction detection mechanism and an output of said installation orientation detection mechanism, whether a loaded direction of said developing means is correct or not relative to said installation orientation.

6. An image forming apparatus according to claim 5, wherein said developing means includes a developing roller that supplies said powdered developer to said latent image carrier, and a pair of drive gears that are fitted around either end of the shaft of said developing roller.

7. An image forming apparatus according to claim 3, wherein said developing means includes a developing roller that supplies said powdered developer to said latent image carrier, and a pair of drive gears that are fitted around either end of the shaft of said developing roller.

8. An image forming apparatus according to claim 1, wherein said positioning mechanism includes setting members which are employed to locate said developing means at said first position and said second position in consonance with a desired loaded direction of said developing means.

9. An image forming apparatus according to claim 8, further comprising a detection member provided in said developing means, and a loaded direction detection mechanism, provided in said positioning mechanism, for sensing the presence of said detection member to determine a loaded direction of said developing means.

10. An image forming apparatus according to claim 9, further comprising an installation orientation detection mechanism for detecting an installation orientation of said image forming apparatus, and a controller for determining, from an output of said loaded direction detection mechanism and an output of said installation orientation detection mechanism, whether a loaded direction of said developing means is correct or not relative to said installation orientation.

11. An image forming apparatus according to claim 10, wherein said developing means includes a developing roller that supplies said powdered developer to said latent image carrier, and a pair of drive gears that are fitted around either end of the shaft of said developing roller.

12. An image forming apparatus according to claim 8, wherein said developing means includes a developing roller that supplies said powdered developer to said latent image carrier, and a pair of drive gears that are fitted around either end of the shaft of said developing roller.

13. An image forming apparatus according to claim 1, wherein said positioning mechanism has a shifting mechanism that moves said developing means to said first position and to said second position.

14. An image forming apparatus according to claim 13, further comprising instructing means manipulated by an operator for issuing an instruction to activate said shifting mechanism.

15. An image forming apparatus according to claim 14, wherein said shifting mechanism includes a movable base for retaining said developing means, and drive means for shifting said base from said first position to said second position or from said second position to said first position.

16. An image forming apparatus according to claim 14, further comprising an installation orientation detecting mechanism for detecting an installed orientation of said apparatus, and a controller for controlling said shifting mechanism in consonance with an output from said installation orientation detecting mechanism.

17. An image forming apparatus according to claim 13, wherein said shifting mechanism includes a movable base for retaining said developing means, and drive means for shifting said base from said first position to said second position or from said second position to said first position.

18. An image forming apparatus according to claim 17, further comprising an installation orientation detecting mechanism for detecting an installed orientation of said apparatus, and a controller for controlling said shifting mechanism in consonance with an output from said installation orientation detecting mechanism.

19. An image forming apparatus according to claim 13, wherein said positioning mechanism has a mechanism for altering a position angle of said developing means relative to said latent image carrier so as to locate said developing means at said first position or at said second position.

20. An image forming apparatus according to claim 13, wherein said shifting mechanism includes a movable base for retaining said developing means, and drive means for shifting said base from said first position to said second position or from said second position to said first position.

21. An image forming apparatus according to claim 13, further comprising an installation orientation detecting mechanism for detecting an installed orientation of said apparatus, and a controller for controlling said shifting mechanism in consonance with an output from said installation orientation detecting mechanism.

22. An image forming apparatus according to claim 1, wherein said positioning mechanism has a mechanism for altering a position angle of said developing means relative to said latent image carrier so as to locate said developing means at said first position or at said second position.

23. An image forming apparatus according to claim 22, further comprising an installation orientation detecting mechanism for detecting an installed orientation of said apparatus, and a controller for controlling said shifting mechanism in consonance with an output from said installation orientation detecting mechanism.

24. A method of forming an image on a sheet, comprising the steps of:

providing an image forming apparatus having a latent image carrier, latent image forming means, developing means, and transferring means;

causing latent image forming means to form a latent image on an endless latent image carrier;

developing the latent image on the latent image carrier by supplying powdered developer of developing means;

transferring a developed image on the latent image carrier to the sheet;

installing the image forming apparatus at an upright orientation or at a horizontal orientation; and positioning the developing means relative to said latent image carrier at a first developing position while the image forming apparatus being installed at the upright orientation and at a second developing position while the image forming apparatus being installed at the horizontal orientation.

25. A method of forming an image on a sheet according to claim 24, further comprising the steps of providing an installation orientation detection mechanism for detecting an installation orientation of said image forming apparatus, and providing a controller for determining, from an output of said installation orientation detection mechanism, whether a loaded direction of said developing means is correct or not relative to said installation orientation.

26. An image forming apparatus, which ensures image forming when positioned either horizontally or upright, comprising:

a rotary, endless latent image carrier;

latent image forming means for forming a latent image on said latent image carrier;

developing means for developing said latent image on said latent image carrier by using powdered developer;

transferring means for transferring a developed image on said latent image carrier to a sheet; and a positioning mechanism for selectively positioning said developing means relative to said latent image carrier, at one of a first position corresponding to an upright installation of said apparatus and a second position corresponding to a horizontal installation of said apparatus; wherein said positioning mechanism determines said first position and said second position of said developing means so that a flow direction of the powdered developer in said developing means is consistent both at the upright and horizontal installation of said apparatus.

27. An image forming apparatus according to claim 26, wherein said positioning mechanism includes setting members which are employed to locate said developing meas at said first position or said second position in consonance with a desired loaded orientation of said developing means.

28. An image forming apparatus according to claim 27, further comprising a detection member provided in said developing means, and a loaded direction detection mechanism, provided in said positioning mechanism, for sensing the presence of said detection member to determine an orientation of said developing means.

29. An image forming apparatus according to claim 28, further comprising an installation orientation detection mechanism for detecting an installation orientation of said image forming apparatus, and a controller for determining, from an output of said loaded direction detection mechanism and an output of said installation orientation detection mechanism, whether a loaded direction of said developing means is correct or not relative to said installation orientation.

30. An image forming apparatus according to claim 29, wherein said developing means includes a developing roller that supplies said powdered developer to said latent image carrier, and a pair of drive gears that are fitted around either end of the shaft of said developing roller.

31. An image forming apparatus according to claim 27, wherein said developing means includes a developing roller that supplies said powdered developer to said latent image carrier, and a pair of drive gears that are fitted around either end of the shaft of said developing roller.

32. An image forming apparatus, which ensures image forming when positioned either horizontally or upright, comprising:

a rotary, endless latent image carrier;

latent image forming means for forming a latent image on said latent image carrier;

developing means for developing said latent image on said latent image carrier by using powdered developer;

transferring means for transferring a developed image on said latent image carrier to a sheet; and a positioning mechanism for selectively positioning said developing means relative to said latent image carrier, at one of a first position corresponding to an upright installation of said apparatus and a second position corresponding to a horizontal installation of said apparatus; wherein said positioning mechanism includes setting members which are employed to locate said developing means at said first position and said second position in consonance with a desired loaded direction of said developing means.

33. An image forming apparatus according to claim 32, further comprising a detection member provided in said developing means, and a loaded direction detection mechanism, provided in said positioning mechanism, for sensing the presence of said detection member to determine a loaded direction of said developing means.

34. An image forming apparatus according to claim 33, further comprising an installation orientation detection mechanism for detecting an installation orientation of said image forming apparatus, and a controller for determining, from an output of said loaded direction detection mechanism and an output of said installation orientation detection mechanism, whether a loaded direction of said developing means is correct or not relative to said installation orientation.

35. An image forming apparatus according to claim 34, wherein said developing means includes a developing roller that supplies said powdered developer to said latent image carrier, and a pair of drive gears that are fitted around either end of the shaft of said developing roller.

36. An image forming apparatus according to claim 32, wherein said developing means includes a developing roller that supplies said powdered developer to said latent image carrier, and a pair of drive gears that are fitted around either end of the shaft of said developing roller.

37. An image forming apparatus, which ensures image forming when positioned either horizontally or upright, comprising:

a rotary, endless latent image carrier;

latent image forming means for forming a latent image on said latent image carrier;

developing means for developing said latent image on said latent image carrier by using powdered developer;

transferring means for transferring a developed image on said latent image carrier to a sheet; and a positioning mechanism for selectively positioning said developing means relative to said latent image carrier, at one of a first position corresponding to an upright installation of said apparatus and a second position corresponding to a horizontal installation of said apparatus; wherein said positioning mechanism has a shifting mechanism that moves said developing means to said first position and to said second position.

38. An image forming apparatus according to claim 37, further comprising instructing means manipulated by an operator for issuing an instruction to activate said shifting mechanism.

39. An image forming apparatus according to claim 38, wherein said shifting mechanism includes a movable base for retaining said developing means, and drive means for shifting said base from said first position to said second position or from said second position to said first position.

40. An image forming apparatus according to claim 38, further comprising an installation orientation detecting mechanism for detecting an installed orientation of said apparatus, and a controller for controlling said shifting mechanism in consonance with an output from said installation orientation detecting mechanism.

41. An image forming apparatus according to claim 37, wherein said shifting mechanism includes a movable base for retaining said developing means, and drive means for shifting said base from said first position to said second position or from said second position to said first position.

42. An image forming apparatus according to claim 41, further comprising an installation orientation detecting mechanism for detecting an installed orientation of said apparatus, and a controller for controlling said shifting mechanism in consonance with an output from said installation orientation detecting mechanism.

43. An image forming apparatus according to claim 37, wherein said positioning mechanism has a mechanism for altering a position angle of said developing means relative to said latent image carrier so as to locate said developing means at said first position or at said second position.

44. An image forming apparatus according to claim 43, wherein said shifting mechanism includes a movable base for retaining said developing means, and drive means for shifting said base from said first position to said second position or from said second position to said first position.

45. An image forming apparatus according to claim 37, further comprising an installation orientation detecting mechanism for detecting an installed orientation of said apparatus, and a controller for controlling said shifting mechanism in consonance with an output from said installation orientation detecting mechanism.

46. An image forming apparatus, which ensures image forming when positioned either horizontally or upright, comprising:

a rotary, endless latent image carrier;

latent image forming means for forming a latent image on said latent image carrier;

developing means for developing said latent image on said latent image carrier by using powdered developer;

transferring means for transferring a developed image on said latent image carrier to a sheet; and a positioning mechanism for selectively positioning said developing means relative to said latent image carrier, at one of a first position corresponding to an upright installation of said apparatus and a second position corresponding to a horizontal installation of said apparatus; wherein said positioning mechanism has a mechanism for altering a position angle of said developing means relative to said latent image carrier so as to locate said developing means at said first position or at said second position.

47. An image forming apparatus according to claim 46, further comprising an installation orientation detecting mechanism for detecting an installed orientation of said apparatus, and a controller for controlling said shifting mechanism is consonance with an output from said installation orientation detecting mechanism.

* * * * *